United States Patent [19]

Belliveau et al.

[11] Patent Number: 4,508,157

[45] Date of Patent: Apr. 2, 1985

[54] SELF-TAPPING SUPPORT FOR SHELL MOLDS

[75] Inventors: Dennis A. Belliveau, Manchester; Eugene W. Thomas, Amherst, both of N.H.

[73] Assignee: Hitchiner Manufacturing Co., Inc., Milford, N.H.

[21] Appl. No.: 485,196

[22] Filed: Apr. 15, 1983

[51] Int. Cl.[3] ..... B22D 27/16

[52] U.S. Cl. ..... 164/63; 164/137; 164/254; 164/339

[58] Field of Search ..... 164/7.1, 61–65, 164/137, 160.1, 253–258, 339, 341

[56] References Cited

U.S. PATENT DOCUMENTS 3,589,199 6/1971 Levin ..... 164/255

4,340,108 7/1982 Chandley ..... 164/63

*Primary Examiner*—Kuang Y. Lin

*Assistant Examiner*—Richard K. Seidel

[57] ABSTRACT

A method of casting metal in a gas permeable shell mold in which a vacuum is applied to an external upper mold surface by engaging the mold in the downwardly facing opening of a generally cylindrical vacuum chamber, defined by a chamber wall with a threaded region sized and shaped to snuggly engage a side mold surface. Engagement is effected by forcing the mold into the chamber opening while causing relative rotation of the mold and chamber.

7 Claims, 7 Drawing Figures

FIG. 1
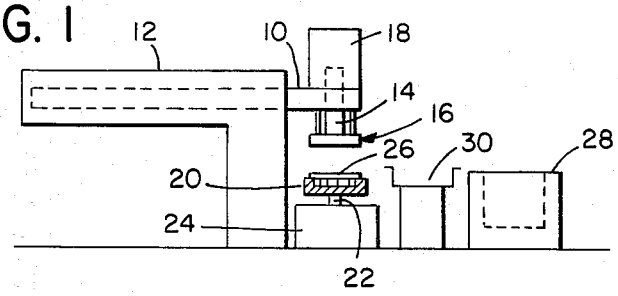
FIG. 2
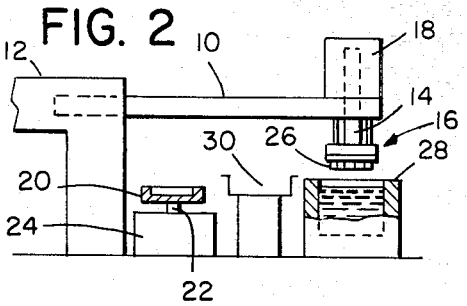
FIG. 3
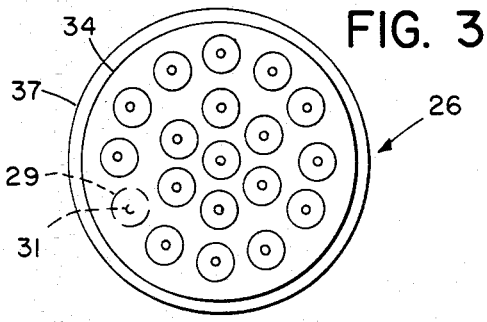
FIG. 4
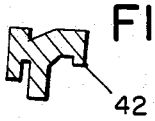
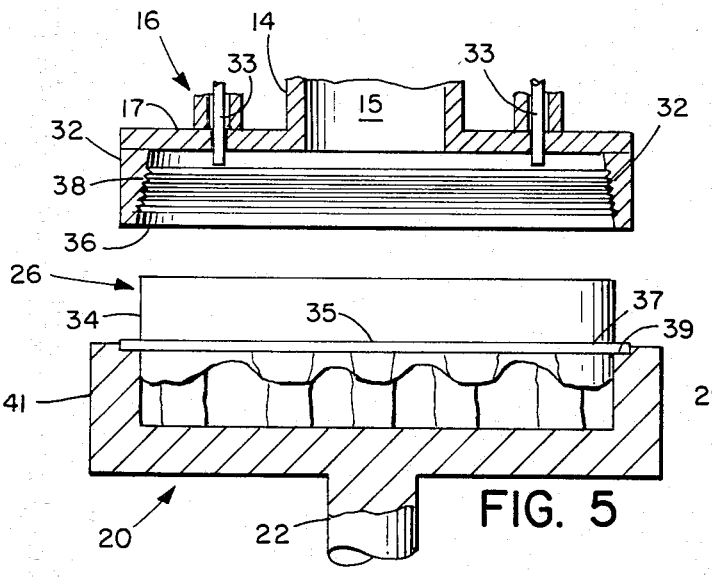
FIG. 5
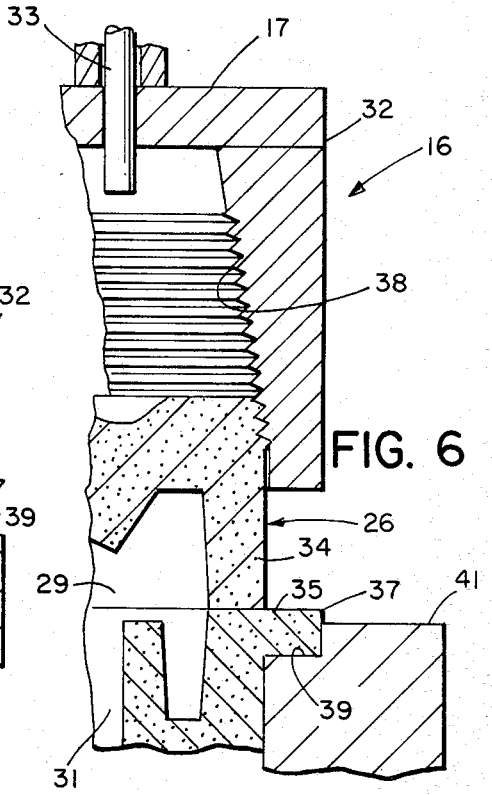
FIG. 6
FIG. 7
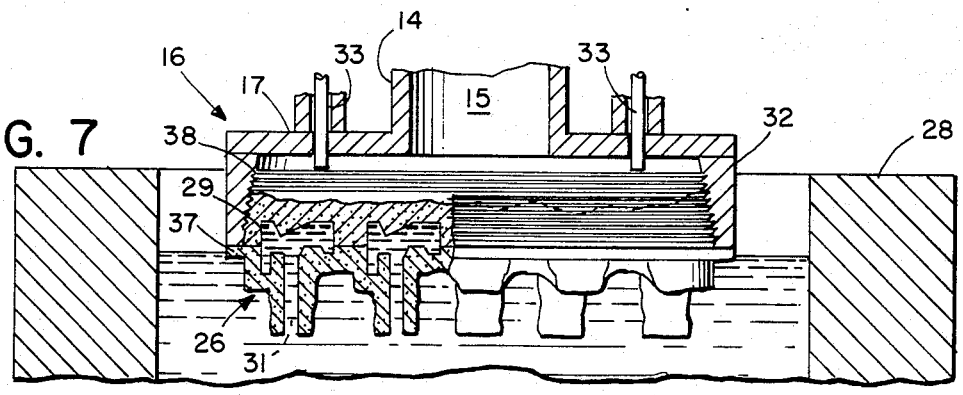

SELF-TAPPING SUPPORT FOR SHELL MOLDS

BACKGROUND OF THE INVENTION

This invention relates to methods of casting metal in bonded sand grain, gas-permeable, shell molds, for example, those described in Chandley et al. U.S. Pat. No. 4,340,108, which is hereby incorporated by reference, and to apparatus used for such casting methods.

As more fully described in Chandley et al., in such a casting method, the top half of a gas-permeable shell mold may be secured to the opening of a hollow support cylinder whose inner chamber is connected to a vacuum pump. In this way, the vacuum in the cylinder chamber draws molten metal into the mold cavity from a reservoir in which the bottom of the mold has been submerged.

It is desirable that the means for attaching and separating the mold to the cylinder be quick, simple, and reliably repeated in a mass-production procedure.

To attach the mold to the cylinder opening during the casting process, Chandley discloses a pair of spring clips, extending upwardly along the outside of the upper side surfaces of the mold; these clips support the mold against the cylinder in position so that the sealing surfaces of the mold abut sealing surfaces of the cylinder. The clips are made of a metal that is destroyed at casting temperatures, thus freeing the mold to be removed when the vacuum is released.

SUMMARY OF THE INVENTION

The invention features a method of casting metal in a bonded sand grain, gas permeable shell mold in which a vacuum is applied to an external upper mold surface by engaging the mold in the downwardly facing opening of a generally cylindrical vacuum chamber, defined by a chamber wall with a threaded region sized and shaped to snuggly engage a side mold surface. Engagement is effected by forcing the mold into the chamber opening while causing relative rotation of the mold and chamber, as well as apparatus therefor.

In preferred embodiments the cylinder wall engagement region tapers outwardly as it extends downwardly; engagement of the mold and vacuum chamber is effected by maintaining the vacuum chamber stationary while rotating the mold and moving its top surface upwardly into the chamber. Disengagement of the mold from the chamber is effected by activating downwardly extending push rods against the upper mold surface.

The above method is a simple and reliable way to attach a shell mold to a vacuum chamber, that is suitable for a mass-production casting operation.

Other features and advantages of the invention will be apparent from the following description of the preferred embodiment and from the claims.

DESCRIPTION OF THE PREFERRED EMBODIMENT

We first briefly describe the drawings.

FIG. 1 is a diagrammatic side view, partly in section, of a mold and apparatus for casting, in which the vacuum chamber is positioned over the mold, prior to engagement.

FIG. 2 is the apparatus of FIG. 1 showing the vacuum chamber and mold positioned for casting.

FIG. 3 is a bottom view of the mold of FIG. 1.

FIG. 4 is a cross section of a metal part.

FIG. 5 is an cross sectional view of a portion of the apparatus shown in FIG. 1.

FIG. 6 is an enlarged cross sectional view showing the vacuum chamber partially attached to the mold.

FIG. 7 is an enlarged cross sectional view of the mold of FIG. 1 partially submerged beneath the surface of a reservoir of molten metal.

The figures show apparatus for casting metal part 42 in a rigid, self-supporting, gas permeable, low temperature bonded, sand grain mold 26. Mold 26 is generally of the type described in Chandley et al., and reference is made to that patent for details of the mold not discussed here. The mold is generally cylindrical and has a top and bottom half which are joined along parting plane 35. The bottom half has an annular flange 37 which extends radially past the perimeter of the top half of the mold. The mold includes a plurality of cavities 29, each of which corresponds to a site for casting a part 42, and a gate passage 31 for each cavity.

Referring to FIGS. 1 and 2, the casting apparatus includes, in addition to cylindrical mold 26 described above, a cylindrical vacuum chamber 16 with a downwardly facing opening 36. Chamber 16 is defined in part by wall 32 which extends generally downwardly from the perimeter of horizontal disk 17. Disk 17 is attached to the lower end of vertical support arm 14 which has a hollow central passage 15 communicating between chamber 16 and vacuum means not shown.

Arm 14 is arranged to slide vertically through one end of horizontal support arm 10, and the end of arm 10 opposite arm 14 is slidably engaged to housing 12. Both arms 10 and 14 are moved by control apparatus 18 which is governed by a programmable controller.

In FIG. 1, horizontal arm 10 is retracted, so that chamber 16 is positioned above mold 26 which is mounted on rotation table 20 controlled by hydraulic shaft 22 and motor 24. In FIG. 2, horizontal arm 10 is extended, so that chamber 16 and mold 26 (which are now engaged) are positioned over molten metal reservoir 28. A conveyer means 30 is positioned intermediate the rotation table 20 and reservoir 28.

FIGS. 5 and 6 show the engagement of chamber 16 to mold 26 in greater detail, and FIG. 7 shows the immersion of mold 26 in reservoir 28. As best shown in FIGS. 5 and 6, chamber 16 is generally cylindrical and has downwardly extending walls 32 which terminate in a downwardly facing opening 36. The lower portion 38 of wall 32 is threaded, and tapers outwardly very slightly (about 10° with respect to the vertical), as it extends downwardly. The diameter of chamber opening 36 is very slightly greater than the diameter of mold 34.

OPERATION

In operation, the above-described equipment is used as follows.

Mold 26 is formed as described in Chandley et al. It is then transported to a work station and is positioned on a rotating table 20, so that flange 37 is seated in groove 39 in table wall 41, and mold sides 34 extend above the table, as shown in FIG. 5.

Support arm 10 is retracted to position chamber 16 directly over mold 26. As table 20 is rotated about 3 revolutions over a period of 2–3 seconds, hydraulic shaft 22 simultaneously forces the table upwardly to push the top mold surface into opening 36, so that chamber wall 32 is forced over side wall 34 of mold 26. The mold is soft enough so that the chamber threads can cut into sides 34, yet hard enough so those threads will hold the mold in place, and maintain sufficient vacuum to permit the casting procedure described by Chandley—e.g. a vacuum of 1–3 psi. The taper of wall 32 ensures that the wall and mold will be tightly engaged, even when the heat from the mold causes the wall to expand. Because wall 32 is tapered, a small (e.g. about 3/16 inch) portion of the mold may be stripped off during the threading process.

After the mold is threaded to cavity 16, arm 14 is raised and arm 10 is extended to position the mold over reservoir 28. Arm 14 is then dropped to submerge the bottom portion of the mold in molten metal (FIG. 7), while a vacuum is maintained in core 15 and cavity 16 to draw molten metal into mold cavities 29.

After the mold cavities have been filed and a portion of each of the gate passages 31 has solidified, arm 14 is retracted to remove chamber 16 from the molten metal reservoir. Arm 10 is partially retracted, placing the mold directly over conveyor 30. Pneumatically controlled rods 33, which extend through the disk 17, are extended to strip the mold and cast parts from the vacuum chamber and deposit them on conveyor 30.

Other embodiments are within the following claims.

We claim:

1. In a method of casting metal in a low temperature bonded sand grain, gas permeable, mold, by applying a reduced pressure to an external upper mold surface to draw molten metal into cavity means in the mold, that improvement comprising, providing a mold having a peripheral, generally cylindrical, exterior side surface portion providing a vacuum chamber having a downwardly facing opening defined by a downwardly extending wall with an internally threaded generally cylindrical engagement surface portion sized and shaped to snugly engage said exterior side surface portion of said mold, engaging said mold with said chamber internally threaded engagement surface portion by moving said upper mold surface into said chamber opening while simultaneously causing relative rotation of said mold and said chamber engagement surface portion, whereby said threads engage said side mold surface portion.

2. The method of claim 1 wherein said engagement portion of said chamber wall tapers outwardly as it extends downwardly.

3. The method of claim 1 further characterized in that, during said engaging step, said mold is rotated, and said chamber is maintained stationary.

4. The method of claim 1 further characterized in that, during said engaging step, said chamber is maintained stationary while the top surface of said mold is moved upwardly into said chamber.

5. The method of claims 1 or 2, wherein said engagement of said mold with said chamber engagement surface portion cuts external threads in said mold exterior side surface portion.

6. Casting apparatus including a container for holding molten metal to provide a molten metal surface in a generally horizontal plane a mold support including a chamber positioned above the surface of molten metal in said container, said chamber having a downwardly extending side wall with a generally cylindrical, internally threaded inner surface portion a rigid, self supporting, gas permeable, low temperature bonded sand grain mold with a side surface extending between vertically spaced upper and lower surfaces, said side surface having a generally cylindrical, externally threaded, exterior side surface portion, and mold cavity means spaced between said upper and lower surfaces, said mold cavity means having gate passage means extending downwardly therefrom, said gate passage means having its lower open end terminating at the lower surface of said mold said mold being supported from above by interengagement of said mold support and mold threaded surface portions, with at least a substantial portion of said mold side surface and the entire lower surface of said mold extending downwardly beyond said chamber side wall power means supporting said mold support and said container for relative movement to move the entire lower surface of said mold including the open end of said gate passage means beneath the surface of molten metal in said container with said mold support side wall spaced thereabove, and vacuum means for relatively varying the pressure within said chamber and said mold to fill said mold after lowering said entire lower surface of said mold beneath the surface of molten metal in said container with said mold support side wall spaced thereabove.

7. Casting apparatus as claimed in claim 6, wherein said chamber internally threaded surface portion tapers outwardly as it extends downwardly.

* * * * *